US012467722B2

(12) United States Patent
Autry

(10) Patent No.: US 12,467,722 B2
(45) Date of Patent: Nov. 11, 2025

(54) NETTING SECURITY SYSTEM

(71) Applicant: David Autry, Winnsboro, TX (US)

(72) Inventor: David Autry, Winnsboro, TX (US)

( * ) Notice: Subject to any disclaimer, the term of this patent is extended or adjusted under 35 U.S.C. 154(b) by 0 days.

(21) Appl. No.: 18/926,275

(22) Filed: Oct. 24, 2024

(65) Prior Publication Data

US 2025/0130021 A1 Apr. 24, 2025

Related U.S. Application Data

(60) Provisional application No. 63/545,496, filed on Oct. 24, 2023.

(51) Int. Cl.
*F41H 13/00* (2006.01)

(52) U.S. Cl.
CPC ..... *F41H 13/0006* (2013.01)

(58) Field of Classification Search
CPC ..... F41H 13/0006
See application file for complete search history.

(56) References Cited

U.S. PATENT DOCUMENTS

| | | | | |
|---|---|---|---|---|
| 1,675,166 | A | 6/1928 | Davidson | |
| 1,902,949 | A | 3/1933 | Condon | |
| 8,661,727 | B2 | 3/2014 | Alfarhan | |
| 9,581,417 | B2 | 2/2017 | Tseng | |
| 10,076,109 | B2 | 9/2018 | Gaskamp et al. | |
| 10,154,663 | B2 | 12/2018 | Brugh et al. | |
| 10,709,128 | B2 | 7/2020 | Barcay et al. | |
| 11,185,065 | B2 | 11/2021 | Denicola | |
| 2005/0166441 | A1* | 8/2005 | Mattox | A01M 23/22 43/1 |
| 2011/0191983 | A1 | 8/2011 | Chen | |
| 2018/0224262 | A1* | 8/2018 | Klein | F41H 13/0006 |

FOREIGN PATENT DOCUMENTS

| | | | |
|---|---|---|---|
| JP | 2012237540 | A | 12/2012 |
| JP | 2019200034 | A | 11/2019 |
| KR | 20100115337 | A | 10/2010 |
| KR | 101939909 | B1 | 1/2019 |
| WO | WO2013014815 | A1 | 1/2013 |

* cited by examiner

*Primary Examiner* — J. Woodrow Eldred
(74) *Attorney, Agent, or Firm* — Kirby Drake

(57) ABSTRACT

A security system may use a netting to apprehend suspects of crime and prevent them from leaving the scene of the crime. The security system can include a netting, trolley system, frame, and triggering device. The netting can be connected to the trolley system. The trolley system can be supported by the frame, which can cover points of egress and ingress of buildings. When the triggering system is activated, netting can travel down the trolley system to apprehend the suspect until law enforcement has a chance to arrive on the scene.

20 Claims, 7 Drawing Sheets

NETTING SECURITY SYSTEM

CROSS-REFERENCE TO RELATED APPLICATION

The present application is a non-provisional of, and claims priority to, U.S. Patent Application No. 63/545,496 filed Oct. 24, 2023, the disclosure of which is incorporated by reference in its entirety.

FIELD OF THE DISCLOSURE

The present disclosure generally relates to security, and more particularly to a suspect apprehension security system.

BACKGROUND

Crime is on the rise in public places like stores, churches, businesses, hotels, and apartments, as well as outdoor settings like parades and festivals. Often dangerous criminals are able to use weapons to scare potential pursuers from following or attempting to apprehend the criminal. These criminals are able to flee the scene with stolen goods or having committed a crime with, at best, a picture of their face for law enforcement to attempt to track them down. While these criminals must use common egress and ingress points to the buildings or areas, there is little or nothing stopping the criminals from escaping through those same entrances and exits with no consequences. Even if law enforcement is contacted immediately, the criminals often have time to flee or hide before law enforcement can arrive.

SUMMARY

Embodiments of the present disclosure may provide a security system comprising: a frame having a plurality of supports, at least one of the plurality of supports receiving a rail; a trolley system configured to move along the rail, the trolley system having a plurality of wheels and at least one lock; a heavy-duty netting connected to the trolley system; and a triggering device configured to activate the trolley system to selectively move and drop the heavy-duty netting on a person encountering the frame, wherein the heavy-duty netting is locked into position on the using the at least one lock when the heavy-duty netting reaches an end of the rail. The trolley system may be removably attached to the frame. The heavy-duty netting may be formed of nylon, steel, aramid fibers, plastic, polyester, and combinations thereof. The at least one lock may be configured to be controlled by the triggering device. The triggering device may be selected from the group comprising: pressure plates, motion detectors, integration into pre-existing security systems, remote control, hardwire, and combinations thereof. The at least one lock may comprise a first lock in the trolley system that when disengaged, the plurality of wheels travel down the rail to release the heavy-duty netting; and a second lock at a bottom of the rail configured to allow the plurality of wheels to pass but not travel back up the rail, keeping the heavy-duty netting in a lowered position over the person. The frame also may include a plurality of arches configured to support the heavy-duty netting before it travels down the rail. The frame may further include one or more braces configured to hold the frame in position; and feet at a bottom of each of the plurality of supports configured to stabilize the frame. The rail may include a plurality of ribs along a length of the rail. The frame may be a temporary structure. A central portion of the heavy-duty netting may be secured with one or more fasteners so that the heavy-duty netting does not sag or fall until it has been released to trap the person. The trolley system also may include a trolley body; a trolley cover; and at least one key shaft configured to receive a key. The plurality of wheels may be configured to fit inside the rail.

Other embodiments of the present disclosure may provide a security system comprising: at least one rail built into a pre-existing area; a trolley system configured to move along the rail, the trolley system having a plurality of wheels; a heavy-duty netting connected to the trolley system; and a triggering device configured to activate the trolley system to selectively move and drop the heavy-duty netting on a person encountering the pre-existing area. The pre-existing area may comprise building walls. The at least one lock may be configured to be controlled by the triggering device. The at least one lock may comprise a first lock in the trolley system that when disengaged, the plurality of wheels travel down the rail to release the heavy-duty netting; and a second lock at a bottom of the rail configured to allow the plurality of wheels to pass but not travel back up the rail, keeping the heavy-duty netting in a lowered position over the person. The rail may include a plurality of ribs along a length of the rail. A central portion of the heavy-duty netting may be secured with one or more fasteners so that the heavy-duty netting does not sag or fall until it has been released to trap the person. The plurality of wheels may be configured to fit inside the rail.

Other technical features may be readily apparent to one skilled in the art from the following figures, descriptions, and claims.

BRIEF DESCRIPTION OF THE DRAWINGS

For a more complete understanding of this disclosure, reference is now made to the following description, taken in conjunction with the accompanying drawings, in which.

DETAILED DESCRIPTION

Embodiments of the present disclosure may provide a security system that can be used to apprehend a person who is suspected of having committed a crime before they are able to leave the scene of the crime. The security system may include heavy-duty netting connected to a trolley system and a triggering device. The trolley system can be built into a pre-existing area or be removably attached to a frame that may be introduced into an area. The triggering device can release the heavy-duty netting to travel down or along the trolley system which can cause the netting to fall on the suspect. When the netting reaches a bottom or end of the trolley system, it can be locked into position over a suspect keeping the suspect in place and not allowing the suspect to free themselves from the netting.

Figure 1A:
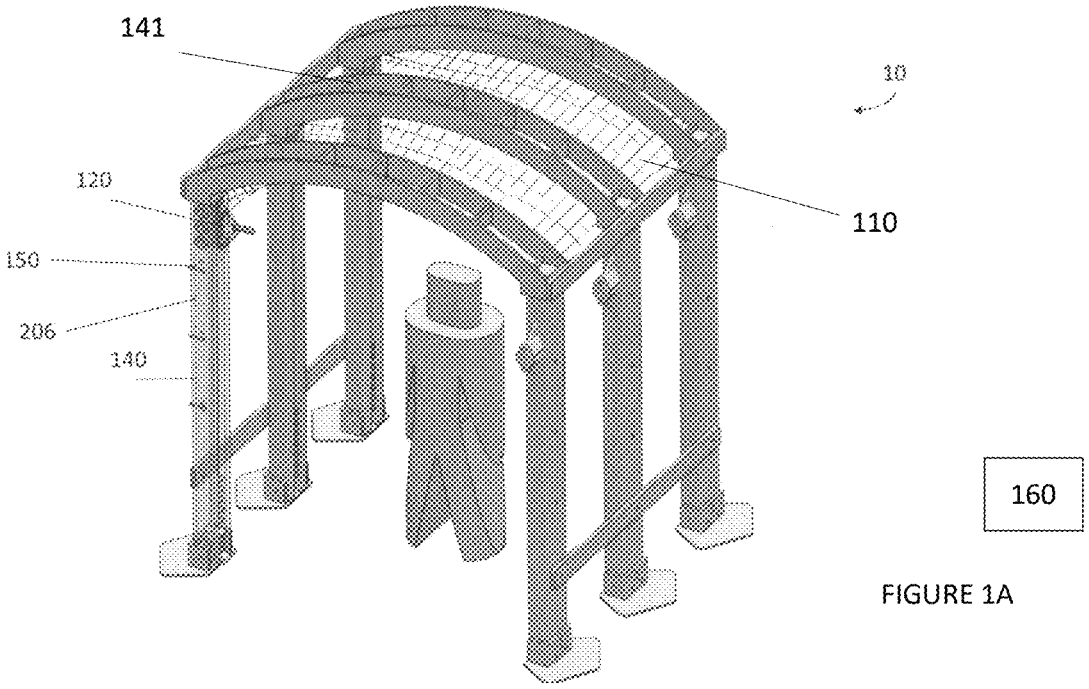
FIGS. 1A-1B depict a perspective view of a security system according to an embodiment of the present disclosure.
Figure 1B:
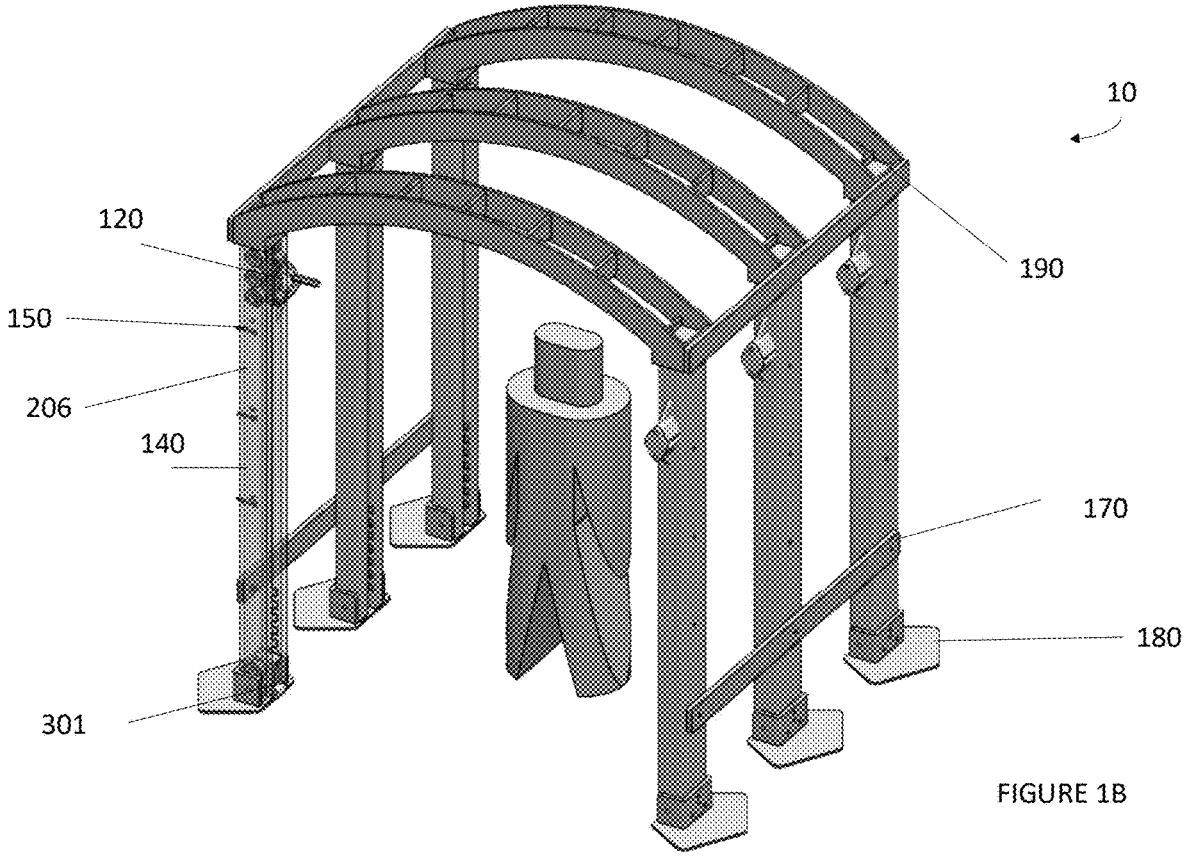

FIGS. 1A-1B depict security system 10 according to an embodiment of the present disclosure. Trolley system 120 may be utilized to move and drop a netting to apprehend a person and can be connected to frame 140. Trolley system 120 can include any number of rails 206 and wheels/rollers 204 (FIG. 2) as needed to accommodate the shape and size of netting 110 and the environment that security system 10 is located. More or fewer rails 206 can also be used depending on the weight and material of netting 110. For example, there may be a rail on each side of netting 110 with at least one trolley that may travel down the rail to drop netting 110. Trolley system 120 can be attached to pre-existing portions of the environment, such as building walls, awning supports, and others, or be attached to frame 140 designed specifically for security system 10 in embodiments of the present disclosure. One or more edges of netting 110 can be connected to trolley system 120. Netting 110 can be of any size or shape needed to accommodate an ingress or egress of a building or area. The size, shape, and configuration of trolley system 120 and frame 140 can change in relation to the size and shape of netting 110. In an embodiment of the present disclosure, there may be two trolley systems on each rail with a bottom trolley for the bottom and a second trolley for the netting.

Netting 110 can be a heavy-duty net that has sufficient weight that it can cause trolley system 120 to move downward, and to restrain the suspect. Netting 110 can be made of nylon, steel, aramid fibers, plastic, polyester, or combinations thereof. Netting 110 can be resistant to cutting to ensure that a suspect is not able to cut their way out before law enforcement has time to arrive. Different materials and weights can be used for netting 110 depending on the location and use of security system 10 in embodiments of the present disclosure. In some embodiments of the present disclosure, netting 110 may be formed as a box upside down positioned within the frame.

Triggering device 160 can be any number of different types of devices that allow for security system 10 to be activated automatically or manually. Triggering device 160 can be connected to each lock 301. Triggering device 160 can be any number of automatic or manual mechanisms that allow for an electronic or physical signal to travel to locks 301 causing locks 301 to disengage. Examples of triggering device 160 can include pressure plates, motion detectors, integration into pre-existing security systems, remote control, hardwire, or combinations thereof. When triggering device 160 is activated, triggering device 160 can disengage each lock 301 (FIG. 3), allowing wheels 204 (FIG. 2) to travel down rail 206 due to the weight of netting 110.

Additional locks 301 can be positioned at a bottom of each support 150. Locks 123 at the bottom of supports 150 can allow wheels 204 to pass but not travel up rail 206, keeping netting 110 in a lowered position. Locks 123 located at the bottom of supports 150 can require a key or second activation of triggering device 160 to disengage to keep any suspects trapped by netting 110 from escaping until law enforcement personnel can arrive.

Frame 140 can define the boundaries of security system 10. Frame 140 may include a plurality of supports 150 along rail 206 to support netting 110 as trolley system 120 moves down rail 206. Frame also may include a plurality of arches 190 that may support netting 110 before it drops down on a person walking below or around the plurality of arches 190. Frame 140 also may include one or more braces 170 that may hold frame 140 in position and feet 180 at a bottom of each of the plurality of supports 150 to stabilize frame 140.

Figure 4:
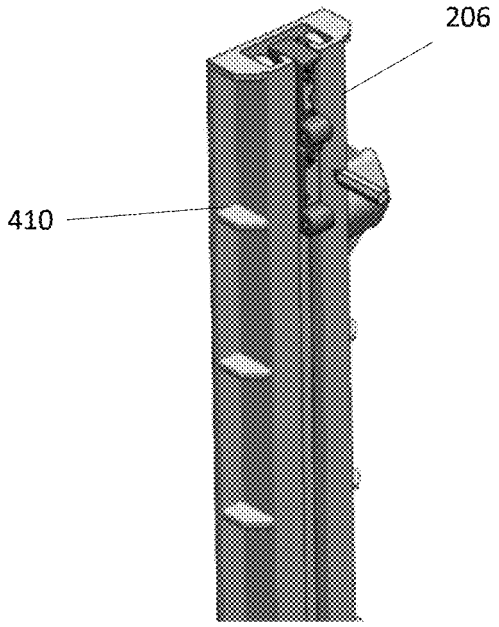
FIG. 4 depicts another embodiment of a rail wherein a plurality of ribs may be provided along the length of the rail.

Rail 206 may be connected to or be received by each of the plurality of supports 150. While three supports 142 are provided on each side of security system 10 in FIG. 1, it should be appreciated that more or fewer supports 150 may be provided without departing from the present disclosure. Further, while supports 150 are depicted relative to rail 206, it should be appreciated that supports 150 may be provided in other locations relative to the netting without departing from the present disclosure. FIG. 4 depicts another embodiment of rail 206 wherein a plurality of ribs 410 may be provided along the length of rail 206. Rail 206 can have a flat surface that can be connected to support 150 and/or frame 140. Rail 206 can also have one or more guards that can be configured to keep wheels 204 in rail 121 and traveling straight. One or more guards can have a space that allows a portion of wheel 204 and/or netting 110 to pass through without getting caught.

Frame 140 can have as many supports 150 as needed to accommodate the shape and size of netting 110. Frame 140 can also have no supports, rather being supported by walls or other sturdy portions of the area or environment in which security system 10 is located. Frame 140 and supports 150 can take any number of shapes to fit the environment or be inconspicuous as desired by the user. Frame 140 can form a tunnel, an arch, or awning, or be clearly marked. Different embodiments of frame 140 can include supports 150 of different weights. Embodiments of frame 140 can be designed to be a permanent fixture at a location. These embodiments can have heavyweight supports 150 designed to withstand damage, long-term wear and tear, and weather. Embodiments of frame 140 designed to be temporary, such as at festivals, parades, or other temporary events, can include lighter weight supports 150 that are configured to withstand damage, but can also be configured to be easily moved and then secured in a new location. A central portion of netting 110 can be secured with one or more fasteners 141 (FIG. 1A) so netting 110 does not sag or fall until it has been released to trap a suspect.

FIGS. 1A-1B depict an embodiment of security system 10 having an arched or domed tunnel shape. To accommodate the shape and increase stability, frame 140 can include one or more braces 170 connecting supports 150. Frame 140 can include a plurality of supports 150 forming a tunnel. In an embodiment of the present disclosure, there may be six supports with three supports on each side; however, there may be more or fewer supports without departing from the present disclosure, and the supports may be placed in a different formation as well. Pairs of supports 150 on opposite sides can be connected by roof struts or arches 190 to form a top of the tunnel. Braces 170 can connect the plurality of supports 150 on the same side. Each support 150 can have one of a plurality of rails 206 connected. Rails 121 can also extend up to roof struts 190. Netting 110 can be connected to wheels 204 that can in turn be connected to each of the plurality of rails 206. Clasps can hold a central portion of netting 110 to each roof strut 190. When triggering device 160 is activated, locks 301 (FIG. 3) can release wheels 204, and clasps can release the central portion of netting 110, allowing netting 110 to fall. When wheels 204 reach locks 301 located at the bottom of rails 206, locks 301 can prevent wheels 204 from raising, trapping any suspects under netting 110.

Figure 2:
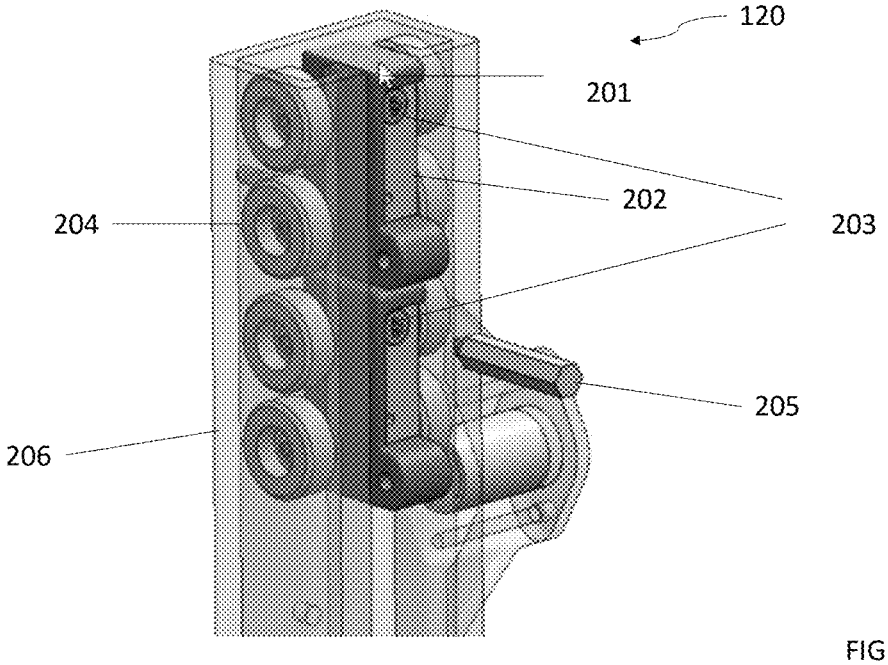
FIG. 2 depicts an expanded view of a trolley system in a security system according to an embodiment of the present disclosure.

FIG. 2 depicts an expanded view of trolley system 120 in security system 10 (FIG. 1) according to an embodiment of the present disclosure. Trolley system 120 may include trolley body 201 with trolley cover 202. At least one key shaft 203 may be provided. FIG. 2 depicts two key shafts 203; however, it should be appreciated that one or more than two key shafts 203 may be incorporated without departing from the present disclosure. At least one key 205 may be provided; however, more than one key may be provided without departing from the present disclosure.

A plurality of wheels 204 may be included as part of trolley system 120. As depicted in FIG. 2, four wheels are provided on each length side of trolley body 201; however, more or fewer wheels may be included without departing from the present disclosure. Wheels 204 may be configured to fit inside rail 206. The plurality of wheels 204 may include, but are not limited to, wheels, rollers, ball bearings, sliders, spheres, or combinations thereof. One or more connectors may allow a portion of netting 110 to be connected to wheels 204. Depending on the type of netting used and/or the shape of netting 110, the one or more connectors can be an opening that can be configured to accept a clip or other type of connector, or the connector can be a clip that can connect to netting 110.

Figure 5A:
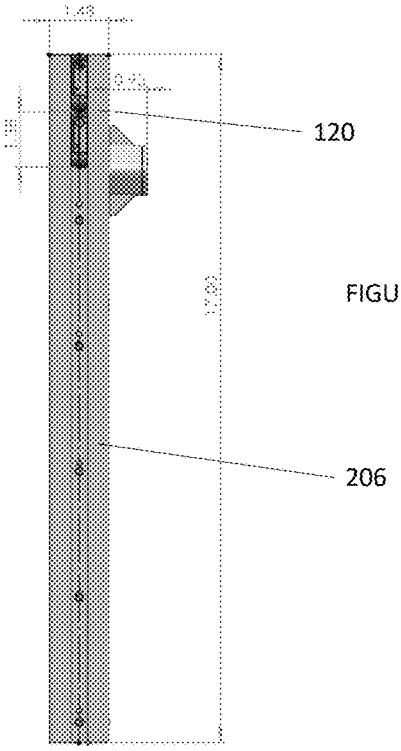
FIGS. 5A-5C depict expanded views of the rail and trolley system according to an embodiment of the present disclosure.
Figure 5B:
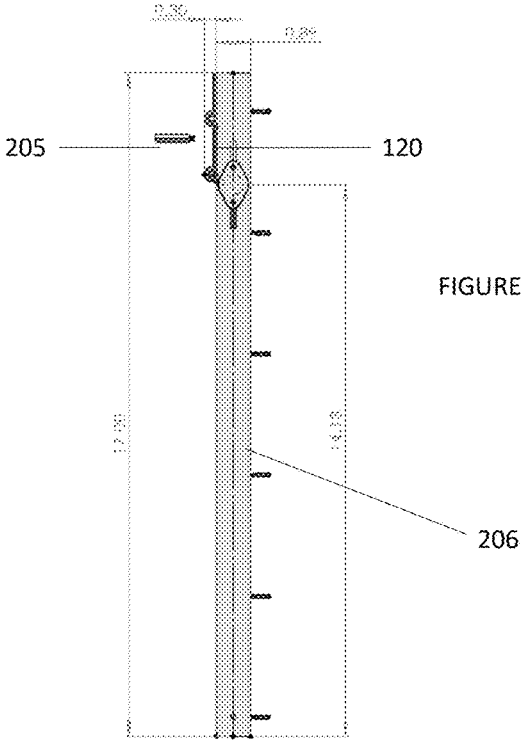
Figure 5C:
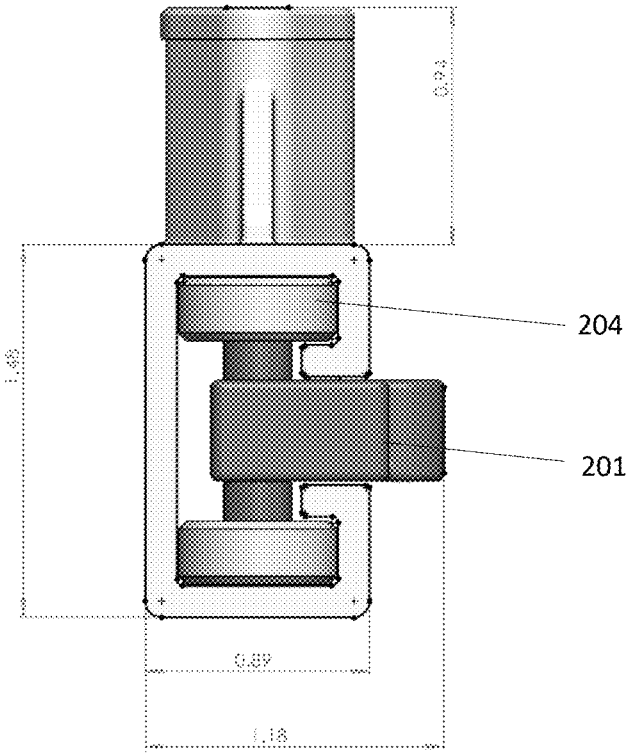

FIGS. 5A-5C depict expanded views of the rail and trolley system according to an embodiment of the present disclosure. More particularly, FIG. 5A depicts a front view of trolley system 120 at a top portion of rail 206. FIG. 5B depicts a side view of trolley system 120 at a top portion of rail 206 with key 205 removed from trolley system 120. FIG. 5C depicts wheels 204 relative to trolley body 201.

Figure 3:
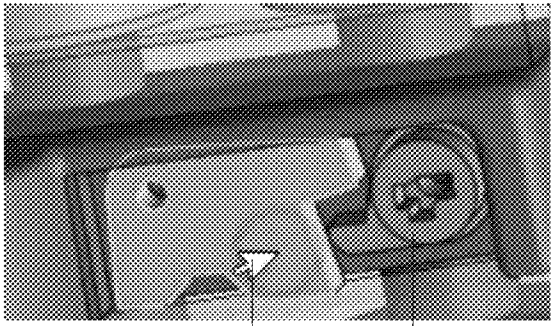
FIG. 3 depicts an exploded view of the internal components of the trolley body according to an embodiment of the present disclosure.

FIG. 3 depicts an exploded view of the internal components of trolley body 201 according to an embodiment of the present disclosure. Key shaft 203 may be provided to receive a key (as depicted in FIG. 2). Lock 301 inside of rail 206 can keep wheels 204 from moving beyond a ready position until security system 10 is activated.

Frame 140 can also have additional components attached to meet the needs of the user. Frame 140 can include lights embedded in or attached to supports 150. Frame 140 can also include walls made of fabric, vinyl, plastic, plaster, wood, metal, glass, or combinations thereof. Certain embodiments of frame 140 may include pre-existing fixtures, such as an awning for an apartment building, to which security system 10 can be attached. Frame 140 can include feet 180 on the bottom of each support 150. The feet can be rubber, plastic, metal, or combinations thereof. Other embodiments of frame 140 can include stakes at the bottom of each support 150 to secure frame 140 to the ground. Embodiments of frame 140 can allow feet or stakes to be swapped and substituted based on the current needs and location of security system 10. Other components can be embedded in or attached to frame 140 without departing from the present disclosure.

Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

The invention claimed is:

1. A security system comprising:

a frame having a plurality of supports, at least one of the plurality of supports receiving a rail;

a trolley system configured to move along the rail, the trolley system having a plurality of wheels and at least one lock;

a heavy-duty netting connected to the trolley system; and a triggering device configured to activate the trolley system to selectively move and drop the heavy-duty netting on a person encountering the frame, wherein the heavy-duty netting is locked into position on the using the at least one lock when the heavy-duty netting reaches an end of the rail.

2. The security system of claim 1, wherein the trolley system is removably attached to the frame.

3. The security system of claim 1, wherein the heavy-duty netting is formed of nylon, steel, aramid fibers, plastic, polyester, and combinations thereof.

4. The security system of claim 1, wherein the at least one lock is configured to be controlled by the triggering device.

5. The security system of claim 1, the triggering device selected from the group comprising:

pressure plates, motion detectors, integration into pre-existing security systems, remote control, hardwire, and combinations thereof.

6. The security system of claim 1, the at least one lock comprising:

a first lock in the trolley system that when disengaged, the plurality of wheels travel down the rail to release the heavy-duty netting; and a second lock at a bottom of the rail configured to allow the plurality of wheels to pass but not travel back up the rail, keeping the heavy-duty netting in a lowered position over the person.

7. The security system of claim 1, the frame further comprising:

a plurality of arches configured to support the heavy-duty netting before it travels down the rail.

8. The security system of claim 1, the frame further comprising:

one or more braces configured to hold the frame in position; and feet at a bottom of each of the plurality of supports configured to stabilize the frame.

9. The security system of claim 1, wherein the rail includes a plurality of ribs along a length of the rail.

10. The security system of claim 1, wherein the frame is a temporary structure.

11. The security system of claim 1, wherein a central portion of the heavy-duty netting is secured with one or more fasteners so that the heavy-duty netting does not sag or fall until it has been released to trap the person.

12. The security system of claim 1, the trolley system further comprising:

a trolley body;

a trolley cover; and at least one key shaft configured to receive a key.

13. The security system of claim 1, wherein the plurality of wheels are configured to fit inside the rail.

14. A security system comprising:

at least one rail built into a pre-existing area;

a trolley system configured to move along the rail, the trolley system having a plurality of wheels;

a heavy-duty netting connected to the trolley system; and a triggering device configured to activate the trolley system to selectively move and drop the heavy-duty netting on a person encountering the pre-existing area.

15. The security system of claim 14, wherein the pre-existing area comprises building walls.

16. The security system of claim 14, wherein the at least one lock is configured to be controlled by the triggering device.

17. The security system of claim 14, the at least one lock comprising:

a first lock in the trolley system that when disengaged, the plurality of wheels travel down the rail to release the heavy-duty netting; and a second lock at a bottom of the rail configured to allow the plurality of wheels to pass but not travel back up the rail, keeping the heavy-duty netting in a lowered position over the person.

18. The security system of claim 14, wherein the rail includes a plurality of ribs along a length of the rail.

19. The security system of claim 14, wherein a central portion of the heavy-duty netting is secured with one or more fasteners so that the heavy-duty netting does not sag or fall until it has been released to trap the person.

20. The security system of claim 14, wherein the plurality of wheels are configured to fit inside the rail.

* * * * *